United States Patent [19]

Takagi et al.

[11] Patent Number: 4,641,951

[45] Date of Patent: Feb. 10, 1987

[54] METHOD AND APPARATUS FOR ELECTROPHOTOGRAPHICALLY REPRODUCING A DESIRED PORTION OF AN ORIGINAL ON COPYING PAPER

[75] Inventors: Tsuneo Takagi; Kenjiro Tanabe; Masao Fukushima; Hiroki Kyushima; Kiyoshi Takenaka; Akira Okada; Yoshinor Isogaki, all of Shiga, Japan

[73] Assignee: Dainippon Screen Mfg. Co., Ltd., Kyoto, Japan

[21] Appl. No.: 745,913

[22] Filed: Jun. 18, 1985

[30] Foreign Application Priority Data

Jun. 25, 1984 [JP] Japan ..... 59-131786

[51] Int. Cl.[4] ..... G03G 15/00

[52] U.S. Cl. ..... 355/7; 355/3 R; 355/3 CH; 355/14 CH; 355/77

[58] Field of Search ..... 355/3 R, 3 ER, 14 C, 355/14 CH, 3 CH, 14 E, 14 R, 7, 77

[56] References Cited

U.S. PATENT DOCUMENTS

| | | | |
|---|---|---|---|
| 3,827,803 | 8/1974 | Shelffo et al. | 355/3 R |
| 3,901,593 | 8/1975 | Kegiso et al. | 355/3 R X |
| 4,047,811 | 9/1977 | Allis et al. | 355/14 R |
| 4,215,929 | 8/1920 | Sato et al. | 355/7 |
| 4,365,885 | 12/1982 | Nishikawa | 355/3 R |
| 4,384,785 | 5/1983 | Katoh et al. | 355/14 CH |
| 4,448,512 | 5/1984 | Bean | 355/3 R |
| 4,534,641 | 8/1985 | Gilliland et al. | 355/3 CH X |

FOREIGN PATENT DOCUMENTS

| | | |
|---|---|---|
| A0016923 | 2/1980 | European Pat. Off. . |
| 3334362A1 | 9/1983 | Fed. Rep. of Germany . |
| 1443371 | 1/1974 | United Kingdom . |
| 1503047 | 9/1976 | United Kingdom . |
| 1514605 | 10/1976 | United Kingdom . |
| 2011647 | 12/1978 | United Kingdom . |
| 2012073 | 1/1979 | United Kingdom . |

*Primary Examiner*—A. C. Prescott

*Attorney, Agent, or Firm*—Brumbaugh, Graves, Donohue & Raymond

[57] ABSTRACT

A method and apparatus for reproducing a desired portion of letters and/or patterns in an original on a copying paper, wherein the system is computerized so as to obtain the necessary information from the data stored with respect to the distance components derived from the original, and on the basis of the information, an area excluding the desired portion of the original is deelectrified so as to exclude the area from the expected reproduction of the desired portion on the copying paper.

15 Claims, 8 Drawing Figures

METHOD AND APPARATUS FOR ELECTROPHOTOGRAPHICALLY REPRODUCING A DESIRED PORTION OF AN ORIGINAL ON COPYING PAPER

BACKGROUND OF THE INVENTION

1. Field of the Invention

The present invention relates to a method and apparatus for electrophotographically reproducing a desired portion of letters and/or patterns in an original on a copying paper. More particularly, the present invention relates to a method and apparatus for such use, wherein the system is computerized so as to electronically transform the desired target portion into data from which the necessary information is obtained for reproduction.

2. Description of the Prior Art

There are often needs for reproducing a desired portion of letters and patterns (hereinafter referred to as the desired target portion or merely the patterns) on a copying paper. One of the common practices is to cover the undesired portion of patterns with a white paper, and the other is to fold it so as to avoid exposure to light.

However, the covering practice is labor-consuming, and is likely to lead to the erroneous production in which the undesired portion of patterns are copied or the desired ones are not copied due to a possible displacement of the cover. The folding practice is not applicable to thick paper nor to a precious original which cannot be folded or otherwise spoiled.

Particularly when the original is of a large-size, such as a construction drawing, and the copying machine is of an equally large scale, the original is placed on a conveyor for automatic feeding. If the original is covered with a paper or folded, thereby resulting in increased thickness, it will be difficut for the original to pass through the conveying path, and may cause a choking trouble.

OBJECTS AND SUMMARY OF THE INVENTION

The present invention is directed toward solving the problems and drawbacks of the conventional practices mentioned above, and it is an object of the present invention to provide a method and apparatus capable of reproducing a desired target portion of the original on a copying paper automatically.

Another object of the present invention is to provide a method and apparatus ensuring the elimination of troublesome manual arrangements for the reproduction of a desired portion.

A further object of the present invention is to provide a method and apparatus capable of reproducing a desired target portion of the original without spoiling the original.

A still further object of the present invention is to provide a method and apparatus for reproducing a desired target portion of the original from an unfoldable thick original.

A still further object of the present invention is to provide a method and apparatus capable of reproducing a desired target portion of the original on a copying paper with the minimum consumption of toner and the minimum fatigue of the photo conductive material on the drum.

Another object of the present invention is to provide a method and apparatus capable of reproducing a desired target portion of the original on a copying paper with a minumum consumption of the copying paper.

Other objects and advantages of the present invention will become more apparent from the following description when taken in connection with the accompanying drawings which show, for the purposes of illustration only, one embodiment in accordance with the present invention.

According to one aspect of the present invention, there is provided a method for reproducing a desired portion of patterns in the original on a copying paper, the method comprising: producing latent images on a photo-conductive rotary drum by projecting light on the original; developing the latent images with toner to produce toner images on the drum; prior to the development of the latent images, deelectrifying a first area of the photo-conductive rotary drum, said first area being exclusive of a second area on the drum corresponding to the desired portion of patterns on the original; and transferring the toner images onto a copying paper, thereby excluding said first area from reproduction onto the copying paper.

According to another aspect of the present invention, there is provided an apparatus for reproducing onto a copying paper a desired portion of patterns on an original, the apparatus comprising: a scanning section in which the original is scanned; a recording section in which the patterns to be reproduced are recorded; an input unit for receiving information about the original and a magnifying factor; a memory unit for storing the information and magnifying factor as data; a rotary drum having a photo-conductive surface on which light from the original is projected so as to produce latent images thereon; a means for electrifying the photo-conductive surface of the drum; a means for deelectrifying the photo-conductive surface of the drum; an arithmetic operating unit for performing an arithmetic operation upon the stored data to produce dimensional information about the reproduction; a first pulse generator connected to the scanning section; a counter for measuring the scanned amount of the original in response to pulse signals from the first pulse generator; a second pulse generator connected to the drum; means for measuring the rotations of the drum in response to the second pulse generator; a decision means for judging whether the desired target portion of the original to be produced exactly corresponds to a predetermined place on the drum in response to signals output from the arithmetic operating unit, the original scanning amount counter, and the means for measuring the rotations of the drum; a first control means for controlling the electrifying means and the deelectrifying means, in response to the signals from the decision means; a second control means for synchronously controlling the scanning section and the drum; a third control means for driving and controlling the recording section; and a central processing unit for controlling the first, second and third control means in a predetermined sequence.

DETAILED DESCRIPTION OF THE PREFERRED EMBODIMENT

Figure 1:
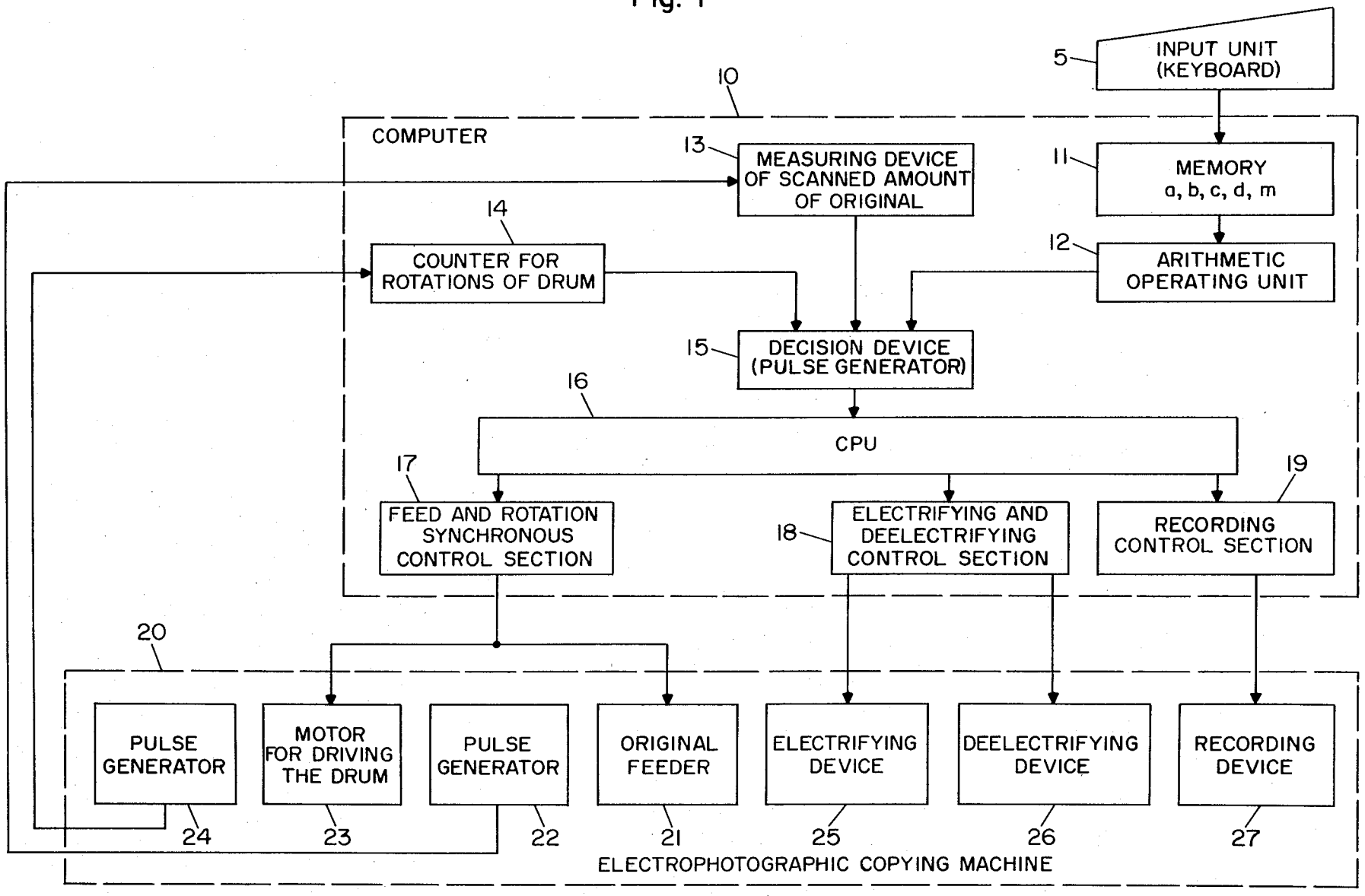
FIG. 1 is a block diagram exemplifying the internal structure of an apparatus embodying the present invention.

FIG. 1 represents the internal structure of an apparatus embodying the present invention, which is comprised of two main portions, a computer 10, and an electrophotographic copying machine 20 which operates automatically under the control of the computer 10, as will be described in detail hereinafter. The computer 10 including a memory 11, an arithmetic operating unit 12, a measuring device 13 for determining the amount or portion of an original which has scanned as the machine 20 operates, a counter 14 for measuring the rotational position of a rotary drum provided with a photosensitive surface, a decision device 15, and a central processing unit (CPU) 16. The CPU 16 provides commands to the three remaining blocks shown within the computer 10 in FIG. 1, namely a feed and rotation synchronous control section 17, an electrifying and deelectrofying control section 18, and a recording control section 19. The computer 10 receives information from an operator through an input unit 5 which may be provided with a keyboard, and which may be incorporated into an operator's console provided with the electrophotographic copying machine 20. The copying machine 20 includes an original feeder 21, a pulse generator 22, a motor 23 for driving the rotary drum, a pulse generator 24 connected to the drum, an electrifying device 25, a deelectrifying device 26, and a recording device 27, connected as shown in FIG. 1 to the computer 10.

Referring to FIGS. 2 and 6 through 8, the electrophotographic copying machine 20 is shown in various views, and is provided with a console 50, an original scanning section 100 on the left-hand side, and a picture recording section 200 on the right-hand side.

Figure 2:
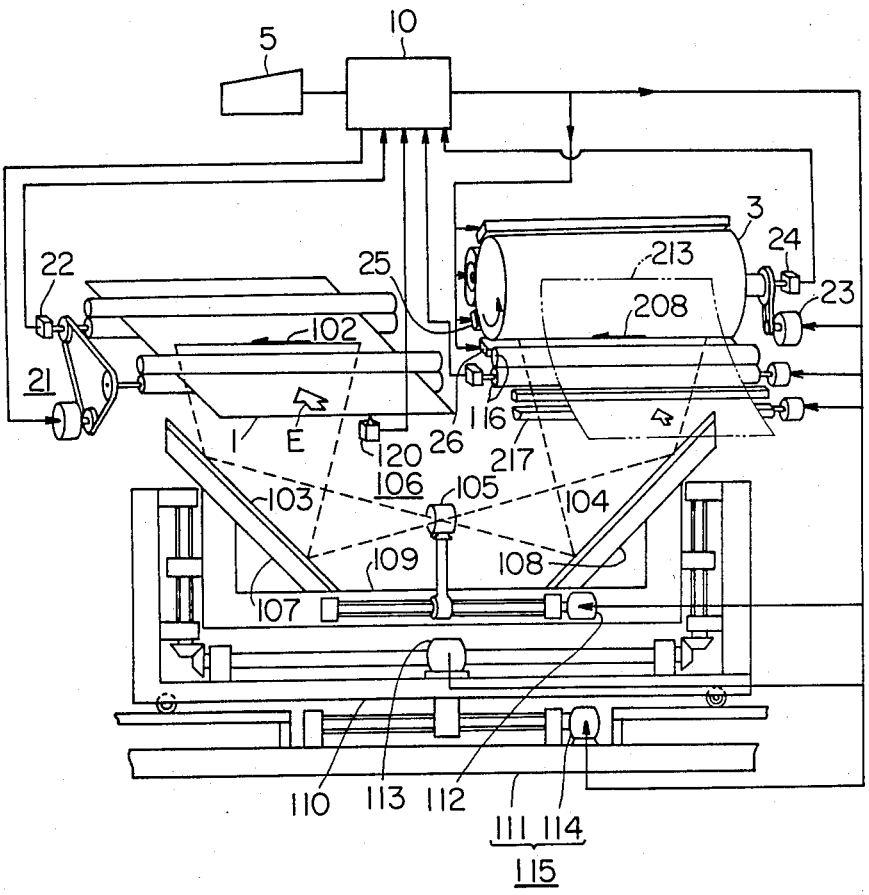
FIG. 2 is a schematic view showing the internal structure shown in FIG. 1.

As illustrated in FIG. 2, an original 1 is fed in the arrow direction (E) in the original scanning section 100, wherein the reference numeral 21 designates a feeder for feeding the orignal 1 successively. The original 1 is lit by means of light equipment (not shown). The copying target 102 in the original 1 is projected onto a photoconductive drum 3 by an optical system 106 which includes a pair of mirrors 103, 104 and a lens 105, while the drum 3 is rotated in the arrow direction (F).

In this way latent images are produced on the drum 3, which are developed by means of a developing unit 202 so as to enable the latent images to become visible thereon as toner images 208. These toner images 208 are transferred onto a copying paper 213 which is fed by means of a copying paper feeder 203, and thus the reproduced images are recorded.

In FIG. 2 the pair of mirrors 103 and 104 are symmetrically fixed each at an angle of 45° to their respective frames 107 and 108, between which the lens 105 is provided such that it can move in its optical axial direction (from left to right or vice versa in FIG. 2) and in the direction perpendicular thereto, the movement in the latter direction being performed by a known driving means (not shown). The optical system 106 is supported by an optical base 109, which is supported by a base frame 110 such that it is moved up and down, thereby varying the optical path of the optical system 106. The base frame 110 is mounted on a machine base 111 such that it is moved from right to left or vice versa.

Under this arrangement, when the magnifying power is to be changed, the optical base 109 is moved by a motor 113 through the operation of the console 50, or alternatively, in accordance with an instruction from the computer 10, thereby varying the length of the optical path of the system 106. At the same time the lens 105 is shifted to the left or right as desired by a motor 112. In this way the desired magnification is achieved. The reference numeral 115 designates an optical integer shifting unit, which includes the machine base 111 and a motor 114. By driving the motor 114 the optical system 106 is wholly shifted to the left or right by a required distance, and the lens 105 is moved in a direction perpendicular to its optical axis. In this way it is possible to record the letters and patterns 2 (hereinafter referred to as the patterns) in the original 1 on the drum 3 at desired positions with respect thereto.

The original feeder 21 shown in FIG. 2 includes a plurality of feed rollers 116 and a motor for driving them, and the original 1 is placed on a table 118 with its face bearing the patterns 2 being downward. The original 1 is conveyed to the original feeder 21.

Figure 7:
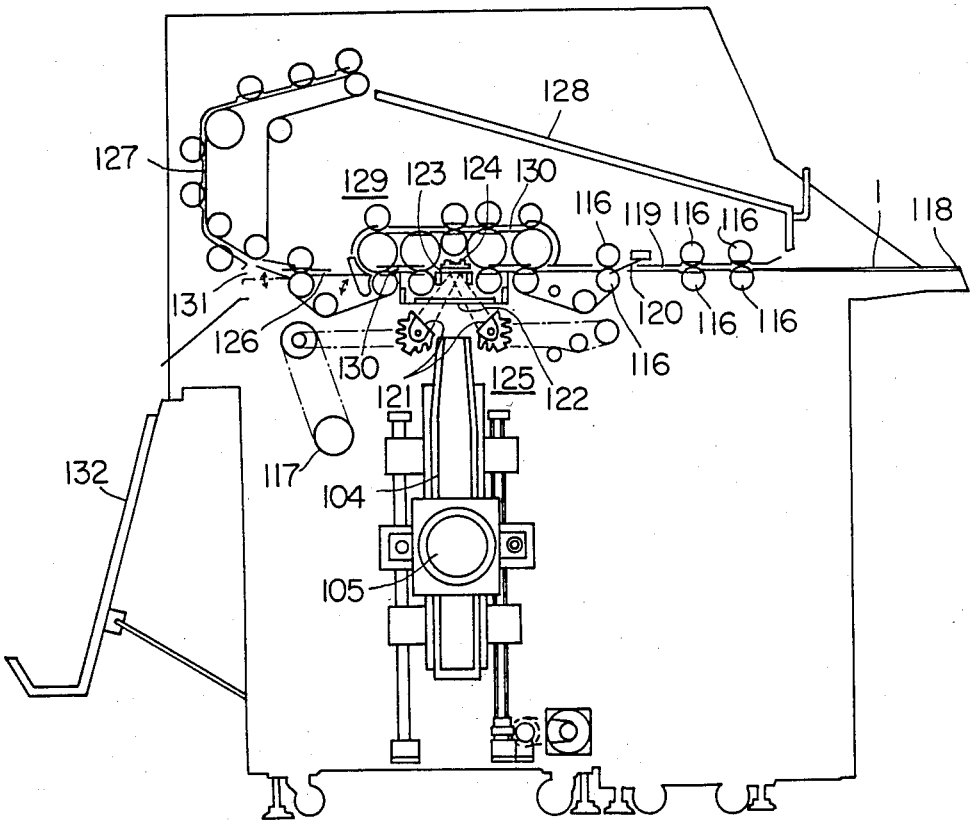
FIG. 7 is a vertical cross-section taken along the line II—II in FIG. 6.

As shown in detail in FIG. 7, there is provided a detector 120 for detecting the forward and backward ends of the original 1 being fed on a feeding path 119. In addition, there are provided a pair of light sources 121, a heatshield glass 122, a glass for original 123, and an original retainer 124, which are referred to as a lighting section 125 to which the original 1 is fed. In this way the original 1 is scanned, and after having been scanned, it is discharged onto an original receiver 128 located above by way of an outlet path 126 and a paper separating path 127.

In the illustrated example an original repeating device 129 is provided, which includes the portion 130 of the feed path which is located opposite to the lighting section 125, thereby recording a plurality of images 2 from the same original 1. The original 1 is fed on the feed path 130 as frequently as desired, during which time the original 1 is scanned by the lighting section 125. In this way the desired number of copies are produced.

When the original 1 is too thick to be curved or bent, it is delivered onto a discharge tray 132 by way of an outlet path 131, instead of advancing to the paper separating path 127.

Figure 8:
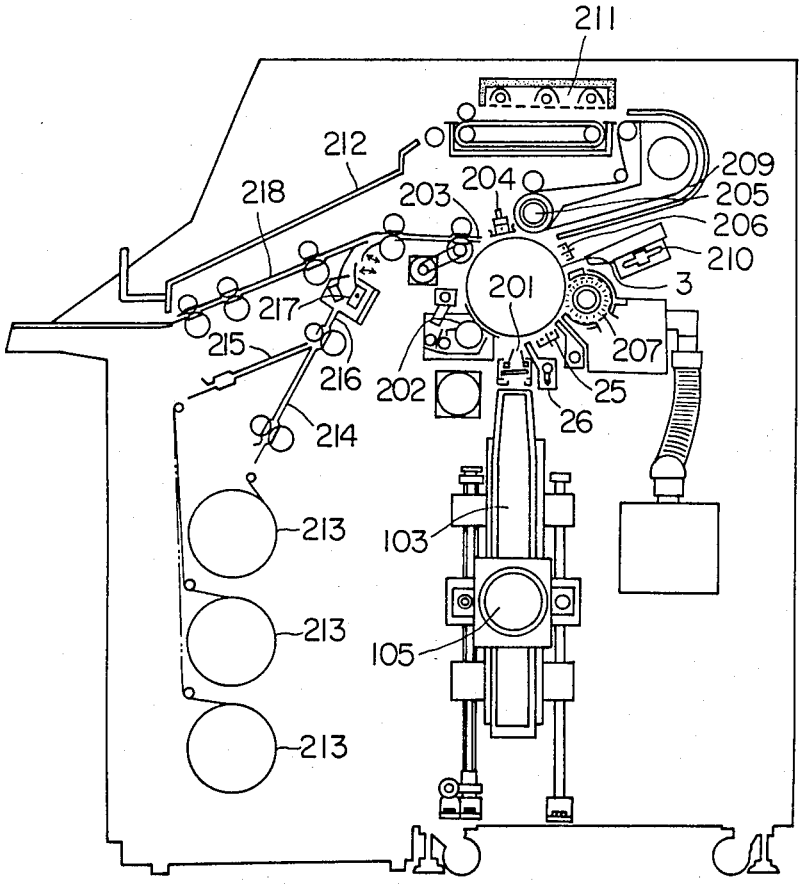
FIG. 8 is a vertical cross-section taken along the line III—III in FIG. 6.

The embodiment shown in FIG. 8 has a recording section 200, which, around the drum 3, includes the electrifying device 25, the deelectrifying device 26, and also has an exposing section 201, a toner developing device 202, a paper supplying section 203, a toner rotor 204, a paper separating device 205, a further deelectrifying device 206 adapted to deelectrify the whole surface of the drum 3 beforehand, and a cleaning device 207.

The deelectrifying device 26 includes a plurality of LEDs (light emitting diodes) or lamps arranged around the drum 3, and is turned on or off through the operation of the control section 18 (FIG. 1).

Referring again to FIGS. 4 through 6, the electronic copying machine of the present invention will be described in greater detail.

Figures 3, 4:
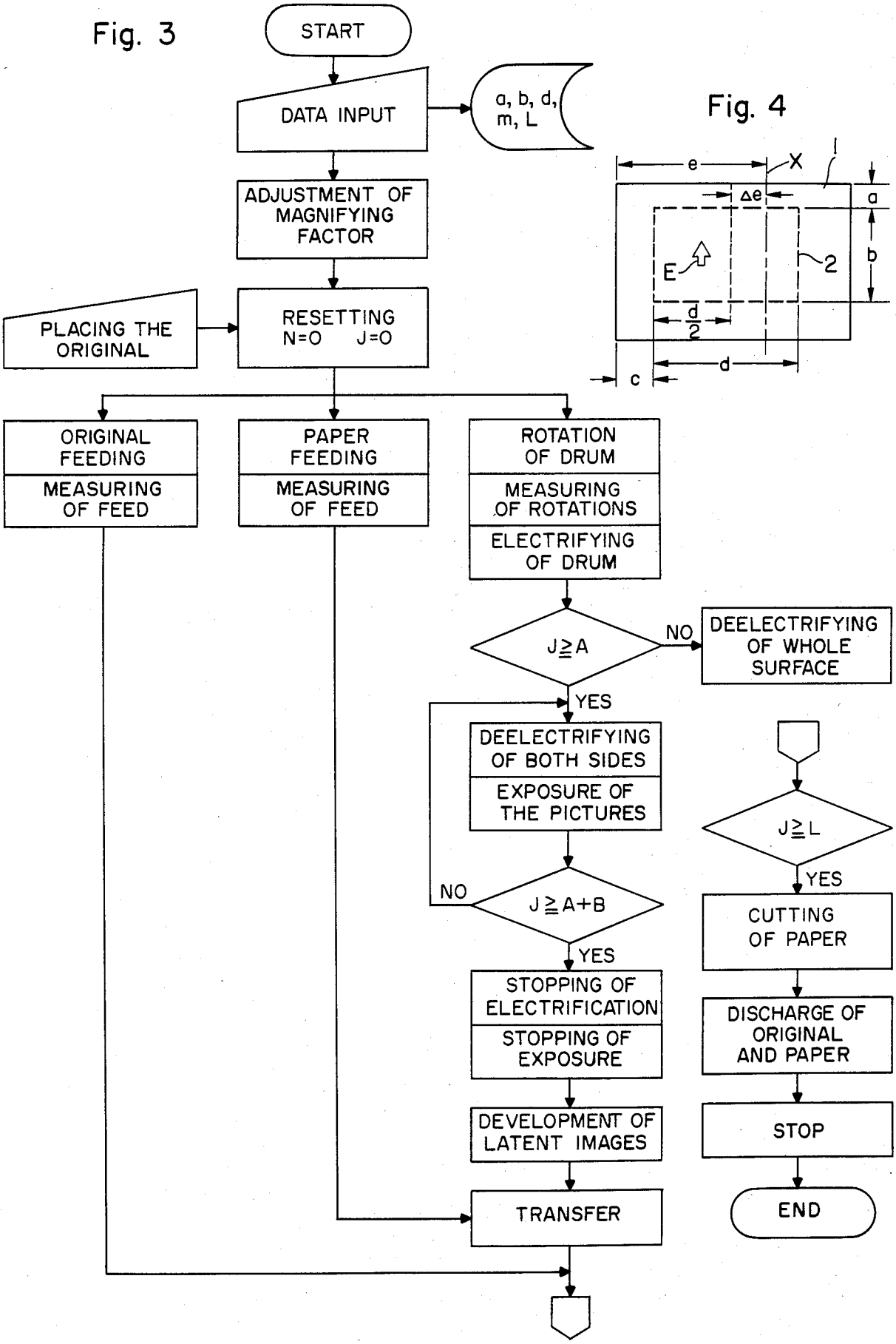
FIG. 3 is a flow chart showing a sequence of operation.
FIG. 4 is a plan view showing the relationship between an original and a pattern section to be copied.

In FIG. 4 the arrow (E) indicates the direction in which the original 1 is fed on the machine. Distance components indicated by (a), (b) and (d) will be hereinafter referred to as the original information, which means the information about the original 1 to be copied. The distance components (a), (b) and (d) are respectively the length between the forward edges of the original 1 and the pattern section 2, the length of the pattern section 2, and the width of the pattern section 2 in direction perpendicular to the arrow direction (E).

Figure 5:
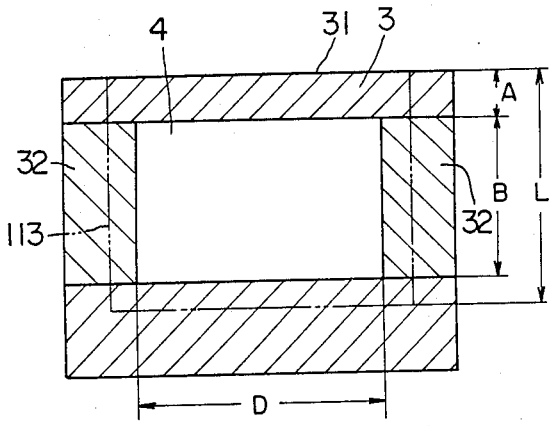
FIG. 5 is a developed view showing the relationship between the drum surface and the pictures to be transferred.
Figure 6:
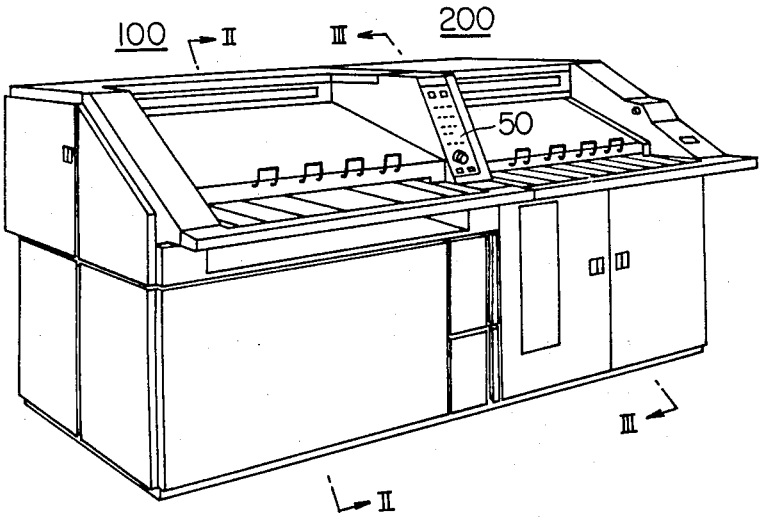
FIG. 6 is a perspective view showing an electronic photography copying machine to which the present invention is applied.

In FIG. 5 there is provided an imaginary reference line 31 on the drum 3, which is used as the starting line at which the rotation of the drum 3 starts sychronously with the feeding of the original 1, with the references line 31 being in alignment with the forward edge of the original 1. Another group of distance components (A), (B) and (D) will be hereinafter referred to as the recorded information. The distance components (A), (B) and (D) are respectively the length between the forward edges of the recorded picture section 4 and the imaginary reference line 31, the length of the recorded picture section 4, and the width of the recorded picture section 4.

When the recorded information is to be produced by duplicating the patterns 2 at the magnification of 1:1, it can be anticipated on the basis of the magnification (m) and the original information.

The original information can include a distance component (c) which is the length between the left-hand edges of the original 1 and the pattern section 2. In the case of a copying machine in which the original 1 is fed with its pattern side being downward, such that the forward edge thereof in the direction of the width abuts the base portion of the table 118, wherein the original 1 is turned upside down with the patterns 2 being downward. The detector 120 detects the forward edge of the original 1, and sends a signal in response to which a CPU (central processing unit) 16 operates a device 13 for measuring the scanned amount of the original 1 and a counter 14 for counting the rotations of the drum 3 so as to reset the respective values N and J to zero.

In accordance with the original information (a), (b), (c) and (d) and the magnification (m), an arithmetic operation unit 12 performs its arithmetic operation so as to decide the position $(A)$ $(=m \cdot a)$ on the drum 3 at which the recording of the pictures 4 is started, and the dimensions of the pictures 4, indicated by $(B)$ $(=m \cdot b)$ and $(D)$ $(=m \cdot d)$. In addition, where necessary, the amount of shift ($\Delta$(e)) of the shifting unit 115, expressed by: $\Delta e = e - (c + d/2)$, is operated by the arithmetic operation unit 12.

The measuring device 13 measures the scanned amount (N) of the original 1 in response to pulse signals from a pulse generator 22 operable in association with the original feeder 21, and the counter 14 counts the rotations (J) of the drum 3 in response to pulse signals from the pulse generator 24.

In FIG. 1 the reference numeral 15 designates a pulse generator which compares the previously operated values for (A) and (B) with the rotations (J) of the drum 3 rotating synchronously with the original feeder 21, in response to the output signals from the arithmetic operation unit 12, the measuring device 13 and the counter 14. Hereinafter, the pulse generator 15 will be referred to as the decision pulse generator.

In response to the signals from the decision single generator 15, the CPU 16 controls the feed and rotation synchronous control section 17, the electrifying and deelectrifying control section 18 and the recording control section 19, which drive and control the original feeder 21 and drum 3, the electrifying device 25 and deelectrifying device 26, and the recording device 27, respectively. In this case the procedure shown in FIG. 3 is taken.

The procedure of FIG. 3 begins with the inputting of data including the original information (a), (b), (c) and (d), the magnification (m), and the desired length (L) of the copying paper. After an adjustment has been to set up to the optical system 106 to the correct magnifying factor, the values of (N) and (J) are reset to zero, and the original scanning section 100 and the picture recording section 200 then operate at the same time to perform the various operations in the sequence indicated in FIG. 3. The procedure of FIG. 3, which is largely self-explanatory, may be better understood by referring as needed to the explanations, provided with respect to the other Figures, about how the various sections and components of machine 20 operate.

For example, in FIGS. 2 and 8, the electrifying device 25 located adjacent to the exposing section 201 starts to electrify the drum 3 crosswise from a line displaced by (A) from the imaginary reference line 31 thereon shown in FIG. 5. The deelectrifying device 26 located rearward of the electrifying device 25 is controlled to deelectrify the portions 32 situated at both sides in the picture section 4, which are outside of the specified width (D) of the pictures.

It is also possible to electrify the whole surface of the drum 3 as the first step, and then deelectrify the surface thereof excluding the pictures 4.

A light through the original 1 is projected on the drum 3 by the exposing section 201 through the optical system 106. In this case the drum 3 is previously provided with static charge at the desired portions in accordance with the original information (a) to (d) and the copying information, and accordingly no latent images are produced for the pictures projected outside the width (D) of the pictures 4 in FIG. 5. The latent images are limited within the width (D).

Subsequently, when the rotations (J) of the drum 3 reach the value (A+B) in FIG. 5, the electrifying device 25, the deelectrifying 26 and the lamp 121 are turned off from one to another. As a result, the latent images corresponding to the desired patterns 2 alone are produced on the drum 3.

It is possible to locate the deelectrifying device 26 behind the exposing section 201. In this case the unnecessary portion of the produced latent images is deelectrified. The latent images are made visible by the toner developing device 202, which are transferred onto the paper 213 fed by the feeder 203. The paper 213 is separated from the drum 3 by the paper separating device 205, and fed to a fixing device 211 located above, whereby the toner images 203 are fixed. The paper 213 having the pictures recorded is delivered onto a receiver chute 218.

When the paper 213 is rolled, a rotary cutter 217 is operated to cut the paper 213 to a desired length.

The detector 120 detects the terminating end of the original 1, in response to which the paper separating path 127 is operated for a predetermined period of time so as to feed the original 1 to the feeder 128. Then the operation of copying machine 20 is stopped.

The recording device 27 shown in FIG. 1 includes the exposing section 201, the toner developing device 202, the paper supplying section 203, a toner transfer press 204, the paper separating device 205, the deelectrifying device 206, and the cleaning device 207.

In the illustrated embodiment the magnification (m) can be varied as desired, but the present invention can be applied to a copying machine in which the magnification (m) is constantly 1, that is, no magnification is effected. In addition, the original 1 is fed while it is scanned, but it is also possible to keep the original 1 motionless whereas the optical system is moved to scan the stationary original 1.

As evident from the foregoing description, according to the present invention various advantages have been achieved, the main ones of which are listed as follows:

1. It is not necessary to shield or mask the unnecessary portion of the original with a white paper, thereby leading to a laborsaving. In addition, there is no fear about a possible displaced mask.

2. It is not necessary to fold the original so as to hide the unnecessary portion of the original against exposure, thereby avoiding spoiling the original, which is sometimes valuable, such as artistic works and unavailable photographs.

3. For the reason mentioned in (2) the reproduction is equally possible even from an unfoldable thick paper.

4. The consumption of the toner is minimized due to the reduction of the copying area to the necessary portion. Likewise, the sensitivity of the photo-polymeric film on the drum is maintained for a relatively long period of time.

5. The amount of paper used for reproduction is minimized due to the reduction of the copying area to the necessary portion.

We claim:

1. A method for reproducing a desired portion of a pattern in an original onto a copying paper, comprising the steps of:

manually inputting information about the desired portion to means for computing reproduction information of the desired portion;

electrifying and deelectrifying a photo-conductive surface of a rotary drum in response to the computed reproduction information so that electrification only results on a surface area of the photo-conductive surface corresponding to the desired portion of the pattern in the original;

exposing the original so as to produce latent images on said photo-conductive surface corresponding to the desired portion;

developing the latent images with toner to produce toner images on the photo-conductive surface;

and transferring the toner images onto the copying paper so that only the desired portion is reproduced.

2. A method as defined in claim 1, wherein said step of electrifying and deelectrifying includes deelectrifying a first area of the photo-conductive surface which is exclusive of a second area corresponding to the desired portion, the deelectrifying being carried out prior to the exposing step, thereby enabling the latent images to be produced only on said second area.

3. A method as defined in claim 1, wherein said step of electrifying and deelectrifying includes deelectrifying a first area of the photo-conductive surface which is exclusive of a second area corresponding to the desired portion, the deelectrifying being carried out after the exposing step, thereby allowing the latent images to remain only on said second area.

4. A method as defined in claim 1, wherein said step of manually inputting information includes determining what portion of the whole photo-conductive surface of the drum constitutes a first deelectrified area based upon informatin about the original including distance between a forward edge of the original and a forward edge of the desired portion in a feeding direction, length of the desired portion in the feeding direction, and width of the desired portion perpendicular to the feeding direction, and upon recorded information including distance between a predetermined reference line on the drum parallel to the axis of the drum and the forward edge of the desired target portion in the feeding direction, length of the desired target portion in the rotating direction of the drum, and width of the desired target portion perpendicular to the rotating direction of the drum, said recorded information being defined in accordance with the information about the original and a desired magnifying factor.

5. A method as defined in claim 4, wherein the step of inputting information about the desired portion further includes inputting the distance between the side edge of the original and the side edge of the desired target portion, and further comprising the step of using the width of the desired target portion perpendicular to the feeding direction and the distance between the two side edges of the original and the desired portion as data to project the images of the desired portion onto a centralized portion of the surface of the drum.

6. An apparatus for reproducing onto a copying paper a desired portion of patterns on an original, the apparatus comprising:

a scanning section in which the original is scanned;

a recording section in which the patterns to be reproduced are recorded;

an input unit for receiving information about the original and a magnifying factor;

a memory unit for storing the information and magnifying factor as data;

a rotary drum having a photo-conductive surface on which light from the original is projected so as to produce latent images thereon;

means for electrifying the photo-conductive surface of the drum;

means for deelectrifying the photo-conductive surface of the drum;

an arithmetic operating unit for performing an arithmetic operation upon the stored data to produce dimensional information about the reproduction;

a first pulse generator connected to the scanning section;

a counter for measuring the scanned amount of the original in response to the pulse signals from the first pulse generator;

a second pulse generator connected to the drum;

means for measuring the rotations of the drum in response to the second pule generator;

decision means for judging whether the desired target portion of the original to be reproduced exactly corresponds to a predetermined place on the drum, in response to signals output from the arithmetic operating unit, the original scanning amount counter, and the means for measuring the rotations of the drum;

first control means for controlling the electrifying means and the deelectrifying means in response to the signals form the decision means so as to electrify only a portion of said drum surface corresponding to the desired portion of the original;

second control means for synchronously controlling the scanning section and the rotary drum;

third control means for driving and controlling the recording section; and a central processing unit for controlling the first, second and third control means in a predetermined sequence.

7. An apparatus as defined in claim 6, wherein the deelectrifying means comprises a plurality of lamps arranged transversely to the direction of rotation of the drum.

8. An apparatus as defined in claim 6, further comprising:

an optical system having a substantially U-shaped optical axis for optically connecting the scanning section and the recording section, which are located at opposite ends of the sides of the U-shape.

9. An apparatus as defined in claim 8, wherein the optical system includes lens means movable along the base of the U-shaped optical axis.

10. An apparatus as defined in claim 8, wherein the optical system comprises:

a pair of mirrors spaced apart from one another and symmetrically positioned about the major axis of the U-shape and inclined toward each other at an angle 45° with respect to the major axis;

a lens located between the pair of mirrors, thereby forming, in conjunction with the mirrors, the U-shaped optical axis, the lens being independently movable along the optical axis;

a movable optical base for supporting the mirrors and lens; and a base frame including means for movably supporting the optical base such that the length of the optical path of the optical system is variable, thereby enabling the magnification to be changed as desired.

11. An apparatus as defined in claim 10, further comprising:

a shifting means for moving the base frame in the direction of the base of the U-shaped optical axis.

12. An apparatus as defined in claim 6, 7, 8, 9, 10 or 11, wherein the original scanning section comprises a plurality of feed rollers arranged in the feeding direction of the original, a motor for driving the feed rollers, a detector for detecting the forward edge and the rearward edge of the original being fed, and a light source for lighting the original.

13. An apparatus as defined in claim 12, wherein the original scanning section further comprises repeating means for recording a plurality of images from the same original.

14. An apparatus as defined in claim 12, wherein the original scanning section further comprises conveyor means for feeding a flat original without bending the flat original.

15. An apparatus as defined in claim 7, further comprising:

an optical system having a substantially U-shaped optical axis for optically connecting the scanning section and the recording section, which are located at opposite ends of the sides of the U-shape.

* * * * *